US011828537B2

(12) United States Patent
Liu

(10) Patent No.: US 11,828,537 B2
(45) Date of Patent: Nov. 28, 2023

(54) FLOATING HEAT PIPE ASSEMBLY AND CLAMP COLLAR FOR USING THEREWITH

(71) Applicant: ASIA VITAL COMPONENTS (CHINA) CO., LTD., Shenzhen (CN)

(72) Inventor: Han-Min Liu, Shenzhen (CN)

(73) Assignee: ASIA VITAL COMPONENTS (CHINA) CO., LTD., Shenzhen (CN)

( * ) Notice: Subject to any disclaimer, the term of this patent is extended or adjusted under 35 U.S.C. 154(b) by 106 days.

(21) Appl. No.: 17/385,913

(22) Filed: Jul. 27, 2021

(65) Prior Publication Data

US 2023/0031618 A1 Feb. 2, 2023

(51) Int. Cl.
*F28D 15/02* (2006.01)
*F28D 15/04* (2006.01)

(52) U.S. Cl.
CPC ..... *F28D 15/0275* (2013.01); *F28D 15/0233* (2013.01); *F28D 15/046* (2013.01)

(58) Field of Classification Search
CPC ... F16L 1/06; F16L 3/1008; F16L 3/14; F16L 3/137; F16L 3/205; F16L 3/12; F28D 15/0275; F28D 15/0233; F28D 15/046
See application file for complete search history.

(56) References Cited

U.S. PATENT DOCUMENTS

2011/0067844 A1* 3/2011 Meyer, IV ..... F28D 15/04 165/104.26
2011/0110042 A1* 5/2011 Zhang ..... F28D 15/0275 165/104.26
2017/0354062 A1* 12/2017 Wang ..... H01L 23/427

FOREIGN PATENT DOCUMENTS

| | | |
|---|---|---|
| CN | 203721538 U | 7/2014 |
| TW | 202045885 A | 12/2020 |
| TW | M619093 U | 11/2021 |

OTHER PUBLICATIONS

Search Report dated Mar. 2, 2023 issued by Taiwan Intellectual Property Office for counterpart application No. 110123195.

* cited by examiner

*Primary Examiner* — Tavia Sullens
*Assistant Examiner* — Khaled Ahmed Ali Al Samiri
(74) *Attorney, Agent, or Firm* — Demian K. Jackson; Jackson IPG PLLC

(57) ABSTRACT

A floating heat pipe assembly includes a floating heat pipe and a clamp collar used with the floating heat pipe. The floating heat pipe has a flattened section that has a flattened pipe size smaller than a pipe size of any other section of the floating heat pipe, so that the floating heat pipe is adjustable at the thinner flattened section for other sections of the floating heat pipe located at two opposite ends of the flattened section to displace to two positions having a height difference between them. The clamp collar is fitted on around the flattened section and includes two symmetrically arranged elastic clamping sections that elastically clamp on two opposite outer sides of the flattened section to hold the same in place, so that the sections of the floating heat pipe located at different heights do not deform to cause reduced or failed capillary action efficiency.

5 Claims, 8 Drawing Sheets

FLOATING HEAT PIPE ASSEMBLY AND CLAMP COLLAR FOR USING THEREWITH

FIELD OF THE INVENTION

The present invention relates to the technical field of heat pipe, and more particularly, to a floating heat pipe assembly and a clamp collar for using therewith.

BACKGROUND OF THE INVENTION

A heat pipe is a hollow metal pipe, in which an adequate amount of working fluid is filled. The principle for the heat pipe to dissipate heat is the two-phase change of the working fluid in the heat pipe. More specifically, the working fluid absorbs heat from a heat source located corresponding to an evaporator section that is located at an end of the heat pipe, such that the working fluid is finally vaporized and changes from a liquid phase into a vapor phase. The vaporized working fluid diffuses in the heat pipe and carries the absorbed heat through a thermal insulated section to a condenser section located at another end of the heat pipe to achieve the purpose of transferring heat to a remote location relative to the heat source.

The currently available heat pipe is usually used with a heat dissipation unit, such as snap-on fins or aluminum-extruded fins or a heat sink, to form a thermal module, which is mounted in an electronic device, such as a computer, a server, a communication chassis, a mobile phone or a hand-held device, to dissipate heat generated by heat sources on a mother board.

However, the packaged heat sources on the mother board of the electronic device are different in their heights. Therefore, it is very possible a height difference is existed between two heat sources and not all the evaporator sections of some heat pipes in the thermal module can be in flat contact with the heat sources. The heat pipe being forcefully connected to two heat sources having a height difference between them is subjected to the risk of reduced heat transfer efficiency or even malfunction. This is because the hollow pipe of the heat pipe is made of a metal sheet material having the same thickness, that is, the evaporator section, the thermal insulated section and the condenser section of the heat pipe are consistent in their pipe wall thickness. In the event the evaporator section or the condenser section of the heat pipe needs to be adjusted in its height location to cover the height difference between two heat sources and the thermal insulated section of the same pipe wall thickness is flexed or bent for this purpose, a bridging force between the evaporator section and the condenser section tends to pull and push the evaporator and the condenser section and to deform due to inward compression or outward pull the thermal insulated section for transferring the vapor-phase working fluid, which would further result in breaking or separation of the wick structure provided on inner wall surfaces of the heat pipe and accordingly, poor heat transfer efficiency or even malfunction of the heat pipe.

It is therefore tried by the inventor to develop an improved floating heat pipe assembly to overcome the problem in the conventional heat pipe.

SUMMARY OF THE INVENTION

A primary object of the present invention is to provide a floating heat pipe assembly, which avoids a floating heat pipe from reduced efficiency of capillary action or malfunction due to a structural deformation of the floating heat pipe caused by a bridging force between two sections of the floating heat pipe having a height difference between them.

Another object of the present invention is to provide a clamp collar for using with a floating heat pipe. The clamp collar is fitted around a flattened section of the floating heat pipe with two elastic clamping sections of the clamp collar clamped on an upper outer side and a lower outer side of the flattened section, so as to hold the flattened section in place from outside of the floating heat pipe and enable the flattened section to resist the bridging force thereat due to a height difference between a front section and a rear section at two opposite ends of the flattened section.

To achieve the above and other objects, the floating heat pipe assembly according to the present invention includes a floating heat pipe and a clamp collar. The floating heat pipe includes a front section and a rear section that respectively have a pipe size, and a flattened section located between the front and the rear section and having a flattened pipe size that is smaller than the pipe sizes of the front and rear sections. The floating heat pipe internally defines a chamber, which extends from the front section through the flattened section to the rear section and has a wick structure and a working fluid provided therein. The clamp collar is fitted on around the flattened section of the floating heat pipe and includes two symmetrically arranged elastic clamping sections and two symmetrically arranged connecting sections. The two elastic clamping sections are clamped on two opposite outer sides of the flattened section, and the two connecting sections are connected to between the two elastic clamping sections.

The two elastic clamping sections are vertically symmetrically arranged at an upper and a lower location and respectively have two connecting ends and an inward protruded middle portion located between the two connecting ends. The middle portions of the two elastic clamping sections are in contact with and pressed against the flattened section of the floating heat pipe. The two connecting sections are laterally symmetrically arranged at a right and a left location and respectively connected at two ends to between the connecting ends of the two elastic clamping sections. And, the two elastic clamping sections and the two connecting sections together define an elastically deformable space in between them.

The elastic clamping sections are respectively concave-shaped or flat-bottomed relative to the flattened section.

The two elastic clamping sections are symmetrically arranged and transversely extended relative to the flattened section and the two connecting sections are symmetrical arranged and vertically extended relative to the flattened section. And, the two elastic clamping sections and the two connecting sections together form a substantially rectangular integral structure.

The two opposite outer sides of the flattened section are an upper outer side and a lower outer side thereof. The floating heat pipe is adjustable at the flattened section for the front section and the rear section to displace to two positions having a height difference between them.

To achieve the above and other objects, the clamp collar according to the present invention is fitted on around a flattened section formed on a local area of a floating heat pipe. The clamp collar includes two elastic clamping sections vertically symmetrically clamped on an upper outer side and a lower outer side of the flattened section and at least one connecting section connected to between the two elastic clamping sections.

The two elastic clamping sections respectively have two connecting ends and an inward protruded middle portion located between the two connecting ends to contact with and press against the flattened section of the floating heat pipe. The at least one connecting section is located between and connected to two connecting ends of the two elastic clamping sections that are located at the same side of the clamp collar. The two elastic clamping sections and the at least one connecting section together define an elastically deformable space in between them.

The two elastic clamping sections are respectively concave-shaped or flat-bottomed relative to the flattened section, and the at least one connecting section is arc-shaped to be concave or convex relative to the flattened section.

In an embodiment, the clamp collar includes two connecting sections, which are laterally symmetrically located between and connected to the connecting ends of the two elastic clamping sections.

The floating heat pipe using the clamp collar has a front section and a rear section located at two opposite ends of the flattened section; and the floating heat pipe is adjustable at the flattened section to displace the front and the rear section to two positions having a height difference between them.

The front section and the rear section of the above floating heat pipe respectively define a pipe size and the flattened section located between the front and the rear section defines a flattened pipe size. The flattened pipe size is smaller than the pipe sizes of the front and rear sections. The floating heat pipe internally defines a chamber, which extends from the front section through the flattened section to the rear section and has a wick structure and a working fluid provided therein.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
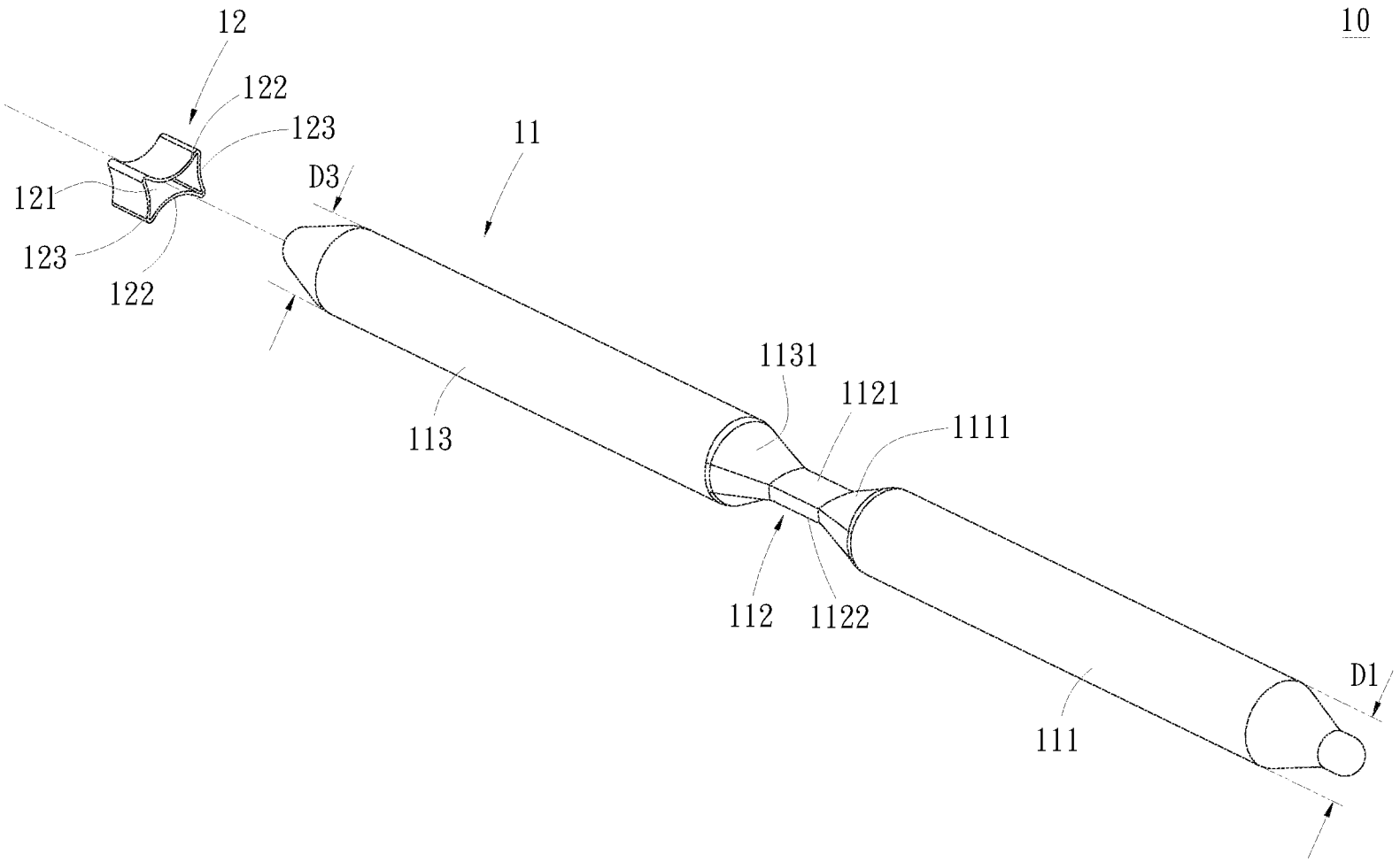
FIG. 1 is an exploded perspective view of a floating heat pipe assembly according to a preferred embodiment of the present invention.

The present invention will now be described with some preferred embodiments thereof and by referring to the accompanying drawings. For the purpose of easy to understand, elements that are the same in the preferred embodiments are denoted by the same reference numerals.

Figure 2:
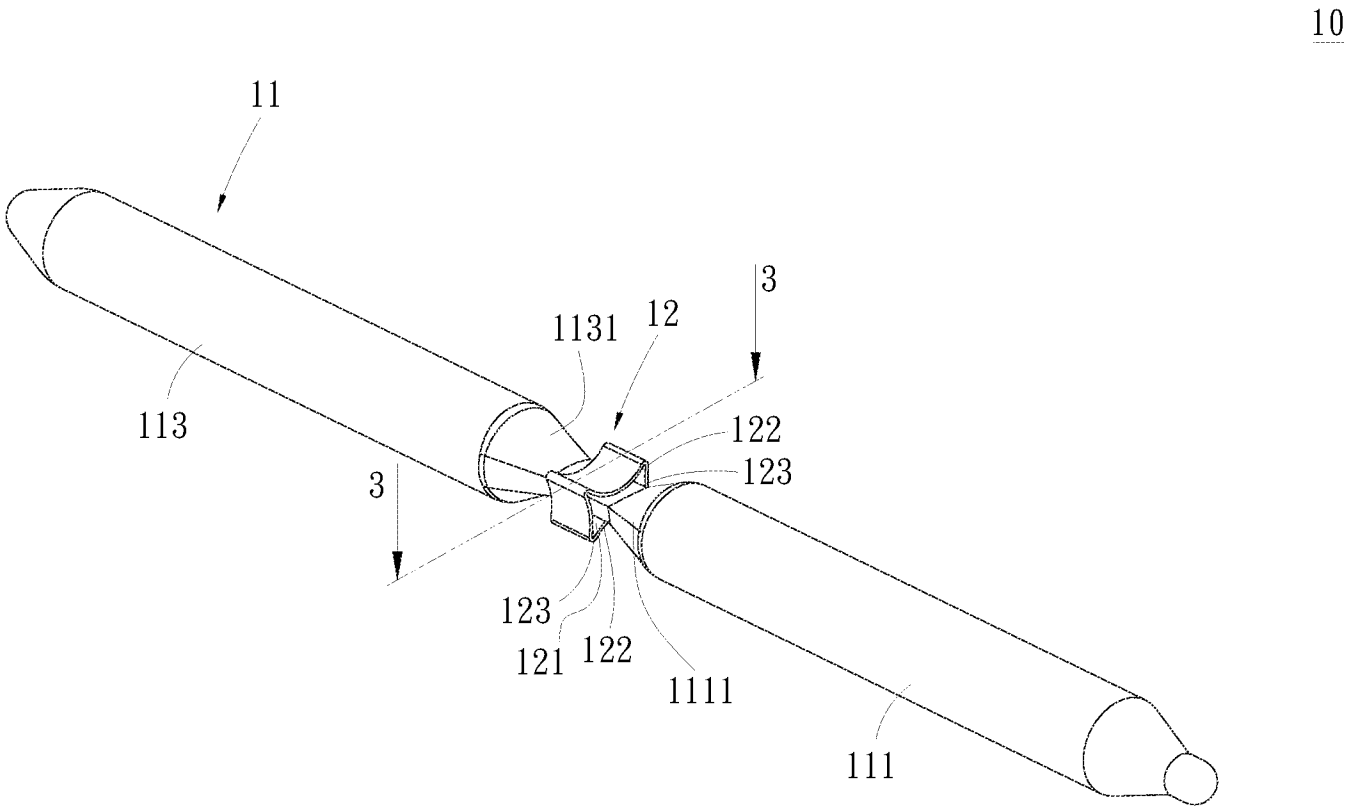
FIG. 2 is an assembled view of FIG. 1.
Figure 4A:
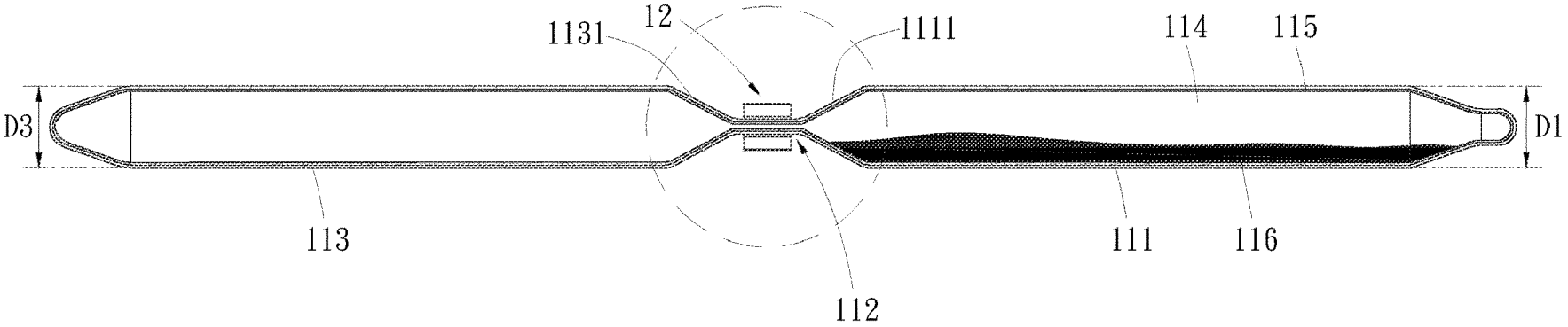
FIG. 4A is a longitudinal sectional view of the floating heat pipe assembly of FIG. 2.
Figure 4B:
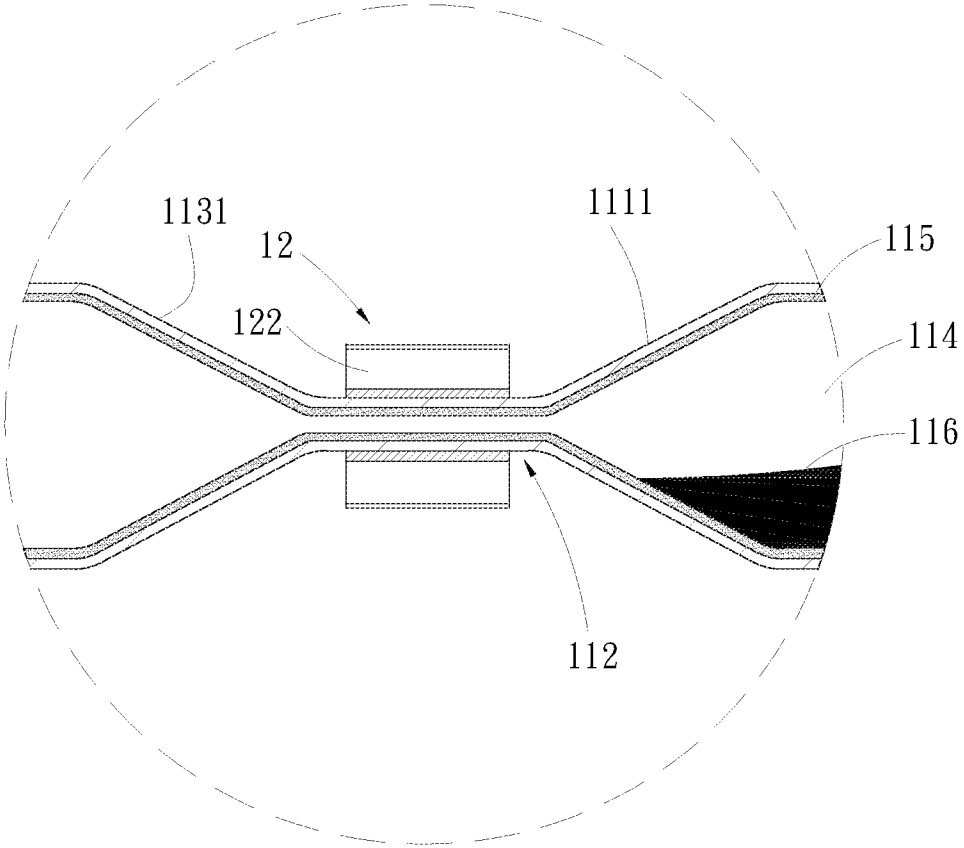
FIG. 4B is an enlarged view of the circled area of FIG. 4A.

Please refer to FIGS. 1 and 2, which are exploded and assembled perspective views, respectively, of a floating heat pipe assembly 10 according to a preferred embodiment of the present invention; and to FIGS. 4A and 4B, which are a longitudinal sectional view of the floating heat pipe assembly 10 and an enlarged view of the circled area of FIG. 4B, respectively. As shown, the floating heat pipe assembly 10 includes a floating heat pipe 11 and a clamp collar 12. The floating heat pipe 11 can be, for example, a round heat pipe and is made of a metal material, such as gold, silver, aluminum, stainless steel, copper, titanium or a metal alloy. The floating heat pipe 11 has a front section 111, a rear section 113, and a flattened section 112 located between and connected to the front section 111 and the rear section 113. The front section 111 and the rear section 113 respectively have a tapered end 1111, 1131, which respectively have a pipe size gradually reduced from the front and the rear section 111, 113 toward the flattened section 112 and are connected to two opposite ends of the flattened section 112. The floating heat pipe 11 internally defines a chamber 114, which extends from the front section 111 through the flattened section 112 to the rear section 113. The chamber 114 has a wick structure 115 and a working fluid 116 provided therein.

The front section 111 and the rear section 113 respectively have, for example, a round cross section and a pipe size D1, D3. In the illustrated preferred embodiment, the pipe sizes D1, D3 are diameters of the round cross sections of the front section 111 and the rear section 113, respectively. The pipe sizes D1 and D3 can be the same as or different from each other without being particularly limited. That is, the pipe size D1 of the front section 111 can be larger or equal to the pipe size D3 of the rear section 113. In addition, the front section 111 and the rear section 113 respectively have another closed end that are located opposite to the flattened section 112 and are two outer most ends of the floating heat pipe 11. It is understood the present invention is not limited thereto. In other operable embodiments, one of the two outer most ends of the floating heat pipe is a closed end while the other one is an open end, and the chamber 114 is communicable with an external chamber, such as the chamber in a vapor chamber or a heat spreader, via the open end.

Further, the flattened section 112 and the front and rear sections 111, 113 are integrally formed. More specifically, the flattened section 112 is formed by pressing a local area of the floating heat pipe 11 from one or two opposite vertical directions. For example, the floating heat pipe 11 can be pressed from an upper or a lower side thereof or from both the upper and lower sides thereof to form the flattened section 112, such that the flattened section 112 is a substantially rectangular structure or a polygonal structure having at least two corresponding sides or surfaces that are arc-shaped or flat-bottomed. The flattened section 112 has two opposite outer sides, which are an upper outer side 1121 and a lower outer side 1122 thereof; and a flattened pipe size D2 defined between the upper outer side 1121 and the lower outer side 1122. The flattened pipe size D2 is smaller than the pipe sizes D1 and D3. That is, the flattened section 112 has an overall thickness smaller than that of the front section 111 and of the rear section 113. Therefore, the floating heat pipe is adjustable at the thinner flattened section 112 to displace the front section 111 and the rear section 113 to two different positions having a height difference between them.

Figure 3:
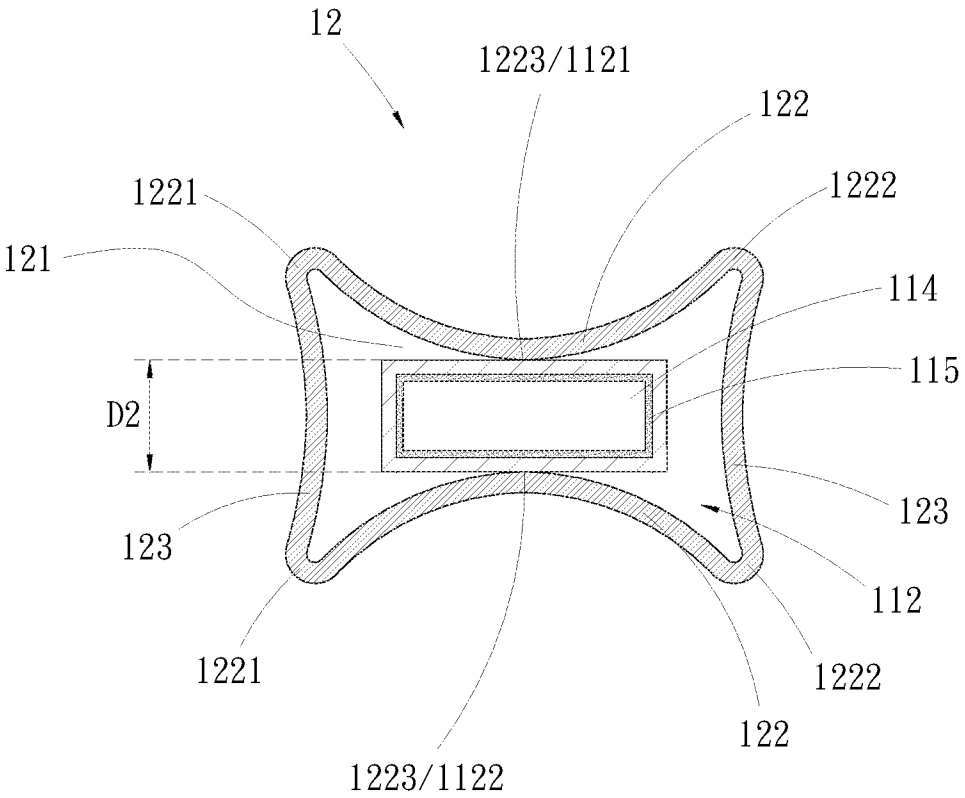
FIG. 3 is a cross sectional view showing a clamp collar included in the floating heat pipe assembly of the present invention is fitted on around a flattened section of a floating heat pipe.

Please also refer to FIG. 3, which is a cross sectional view of the clamp collar 12. The clamp collar 12 is fitted on around the flattened section 112 of the floating heat pipe 11, and includes two elastic clamping sections 122 symmetrically located at an upper and a lower side of the clamp collar 12 and two connecting sections 123 symmetrically located at a right and a left side of the clamp collar 12. The two elastic clamping sections 122 and the two connecting sections 123 together define an elastically deformable space 121 in between them. In some operable embodiments, the two elastic clamping sections 122 and the two connecting sections 123 can be made of the same or different materials. In the illustrated preferred embodiment, a material with elasticity, such as a plastic material, including a thermoplastic elastomer (TPE), or a rubber material or a silicon material, is preferably selected for forming the clamp collar 12. In other operable embodiments, an elastic metal material, such as a nickel titanium alloy or a shape-memory alloy, can be selected for forming the clamp collar 12.

The two elastic clamping sections 122 and the two connecting sections 123 together form an integral structure. In the illustrated preferred embodiment, both of the elastic clamping sections 122 and the connecting sections 123 are concave in shape relative to the flattened section 112, as shown in FIG. 3.

The two elastic clamping sections 122 clamp on the two opposite outer sides of the flattened section 112, and respectively define two connecting ends 1221, 1222. An inward protruded middle portion 1223 of each of the elastic clamping sections 122, i.e. the bottom of the concave elastic clamping section 122, is located in middle between the two connecting ends 1221, 1222; and the inward protruded middle portions 1223 respectively contact with and press against the upper outer side 1121 and the lower outer side 1122 of the flattened section 112. The two connecting sections 123 are respectively located between and connected to the connecting ends 1221, 1222 of the elastic clamping sections 122 for supporting the two elastic clamping sections 122. It is noted the two connecting sections 123 are not in contact with the flattened section 112. In the drawings, the two elastic clamping sections 122 are represented as being symmetrically arranged and transversely extended relative to the flattened section 112 while the two connecting sections 123 are symmetrically arranged and vertically extended relative to the flattened section 112, such that for corners are formed at joints of the elastic clamping sections 122 and the connecting sections 123. In the illustrated preferred embodiment, the clamp collar 12 is integrally formed by injection molding or 3D printing.

Before the clamp collar 12 is fitted on around the flattened section 112, the two elastic clamping sections 122 and the two connecting sections 123 are outward pulled to expand the elastically deformable space 121, such that the clamp collar 12 can be conveniently moved through the front section 111 or the rear section 113 of the floating heat pipe 11 to the flattened section 112. When the clamp collar 12 has been moved to the flattened section 112, the two elastic clamping sections 122 and the two connecting sections 123 are released and they can elastically restore their original positions. Meanwhile, the elastically deformable space 121 is also restored its original condition.

Figure 5A:
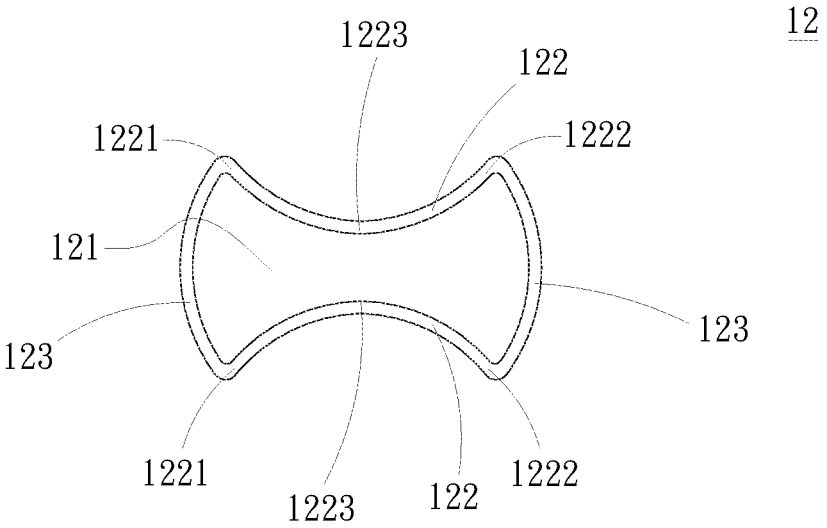
FIGS. 5A to 5C illustrate some examples of the clamp collar available for use.
Figure 5B:
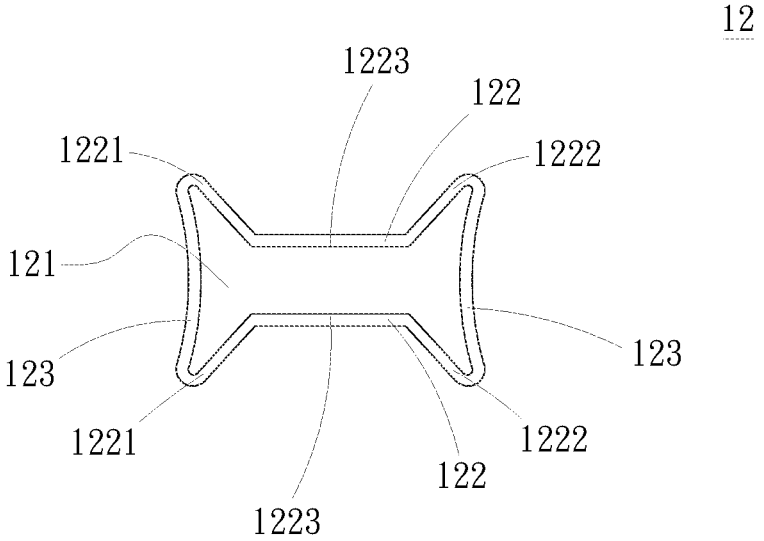
Figure 5C:
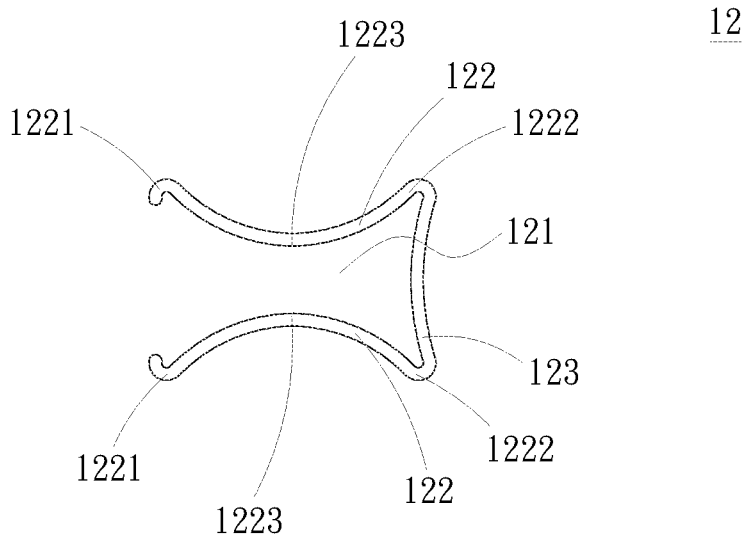

Please refer to FIGS. 5A to 5C, in which examples of different shapes available for the clamp collar 12 are shown. In an embodiment as shown in FIG. 5A, the clamp collar 12 has two connecting sections 123 that are convex in shape relative to the flattened section 112. In another embodiment as shown in FIG. 5B, the two elastic clamping sections 122 are inward recessed and flat-bottomed relative to the flattened section 112. In a further embodiment as shown in FIG. 5C, the clamp collar 12 can be configured as a substantially C-shaped or a reverse C-shaped structure. That is, the clamp collar 12 has only one connecting section 123 that is located between and connected only to the connecting ends 1221 or the connecting ends 1222 of the two elastic clamping sections 122. In the example illustrated in FIG. 5C, the connecting section 123 is connected to between the connecting ends 1222.

Figure 6:
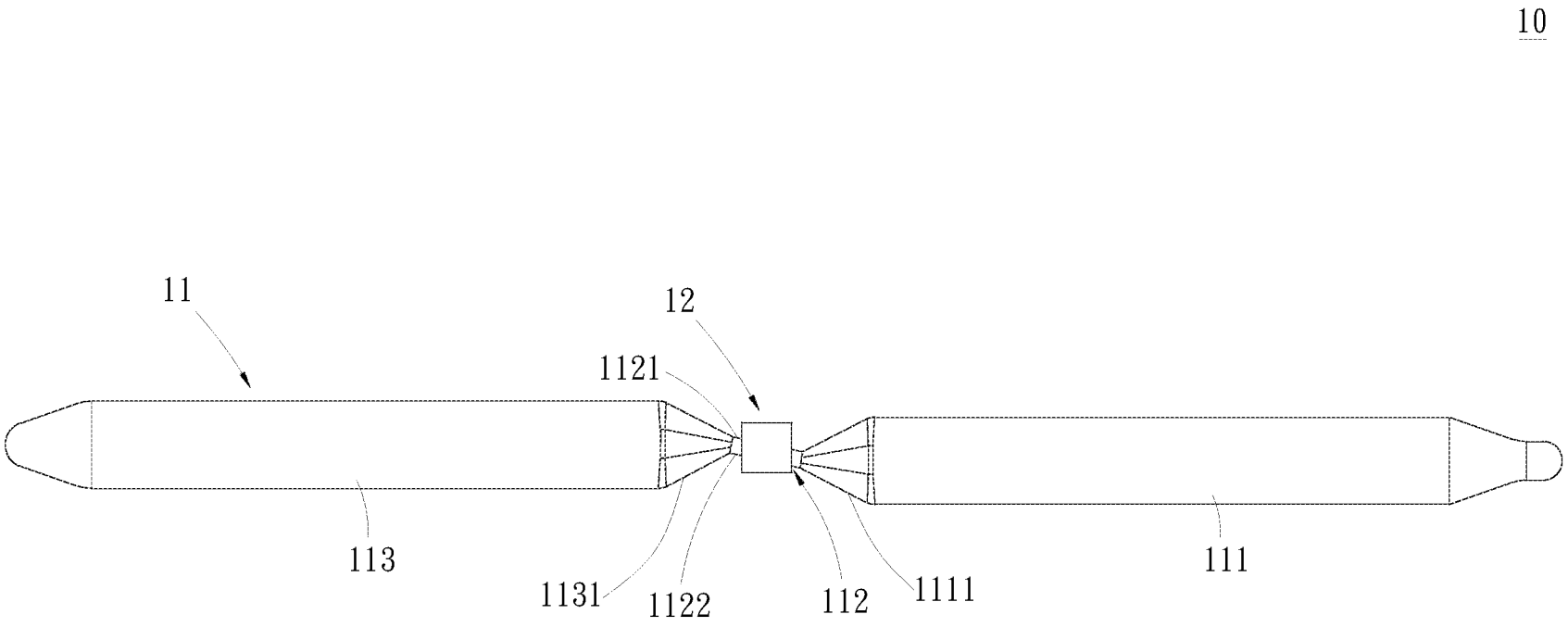
FIG. 6 is a side view showing a front section and a rear section of the floating heat pipe assembly are displaced to form a height difference between them.

Please refer to FIG. 6, which shows the floating heat pipe 11 of the floating heat pipe assembly 10 of the present invention is adjustable to displace the front section 111 and the rear section 113 thereof to two positions having a height difference between them. Please refer to FIG. 6 along with FIG. 3. When the floating heat pipe 11 is adjusted at the flattened section 112 for the front section 111 and the rear section 113 to displace to two positions that have a height difference between them, the clamp collar 12 fitted on around the flattened section 112 of the floating heat pipe 11 with the two elastic clamping sections 122 clamped on the upper outer side 1121 and the lower outer side 1122 of the flattened section 112 can provide a reinforcing force to the flattened section 112 from an outer side of the floating heat pipe 11, so that the flattened section 112 can resist a bridging force that is formed at the flattened section 112 due to the height difference between the front and the rear section 111, 113. With these arrangements, the floating heat pipe 11 can avoid the structural deformation and reduced or failed capillary action efficiency due to the bridging force formed between the differently located front and rear sections 111, 113.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A floating heat pipe assembly comprising: a floating heat pipe including a front section and a rear section that respectively each have a pipe size, and a flattened section located between the front and the rear section and having a flattened pipe size that is smaller than the pipe sizes of the front and of the rear sections; the floating heat pipe internally defining a chamber, which is extended from the front section through the flattened section to the rear section and has a wick structure and a working fluid provided therein, and a clamp collar fitted on around an outer surface of the flattened section of the floating heat pipe; the clamp collar including two symmetrically arranged elastic clamping sections and two symmetrically arranged connecting sections; wherein the two elastic clamping sections are clamped on two opposite outer sides of the flattened section and are each concave-shaped or flat-bottomed relative to the flattened section, wherein two corresponding ends of each of the two connecting sections are respectively connected to the two elastic clamping sections, and wherein the connecting sections are concave or convex relative to the flattened section and do not contact the flattened section.

2. The floating heat pipe assembly as claimed in claim 1, wherein the two elastic clamping sections are arranged on a top and a bottom of the flattened section of the floating heat pipe and respectively have two connecting ends and an inward protruded middle portion located between the two connecting ends; the inward protruded middle portions of the two elastic clamping sections each contacting and pressing against the flattened section of the floating heat pipe; wherein the two connecting sections are arranged at two respective lateral sides of the flattened section of the floating heat pipe and wherein two corresponding ends of each of the connecting sections are connected to the connecting ends of the two elastic clamping sections; and the two elastic clamping sections and the two connecting sections together define an elastically deformable space in between them.

3. The floating heat pipe assembly as claimed in claim 1, wherein the two elastic clamping sections are symmetrically arranged and transversely extended relative to the flattened section and the two connecting sections are symmetrically arranged and vertically extended relative to the flattened section, and the two elastic clamping sections and the two connecting sections are integrally formed.

4. The floating heat pipe assembly as claimed in claim 1, wherein the two opposite outer sides of the flattened section are an upper outer side and a lower outer side thereof, wherein the front section and the rear section are respectively located at two different positions having a height difference between them, and wherein the clamp collar holds the flattened section in place from outside of the floating heat pipe.

5. The floating heat pipe assembly as claimed in claim 1, wherein the front section and the rear section each respectively have a tapered end; the pipe size of the front and the rear section at their respective tapered end gradually reduces from the front and the rear section toward the flattened section, and wherein the tapered ends are connected to two opposite ends of the flattened section.

* * * * *